United States Patent [19]

Reinsch

[11] 4,405,882

[45] Sep. 20, 1983

[54] AIR FLOW SENSOR

[75] Inventor: Stephen J. Reinsch, Vista, Calif.

[73] Assignee: Hughes Aircraft Company, El Segundo, Calif.

[21] Appl. No.: 213,986

[22] Filed: Dec. 8, 1980

[51] Int. Cl.[3] ..... H01J 61/52

[52] U.S. Cl. ..... 315/118; 73/861.75; 116/273

[58] Field of Search ..... 315/112, 118; 116/273; 73/861.75, 861.76; 340/610; 200/81.9 R

[56] References Cited

U.S. PATENT DOCUMENTS

| | | | |
|---|---|---|---|
| 825,863 | 7/1906 | Oliver | 73/861.75 X |
| 2,166,685 | 7/1939 | Henderson et al. | 315/118 |
| 2,516,215 | 7/1950 | Jennings | 315/118 |

*Primary Examiner*—Eugene R. La Roche

*Attorney, Agent, or Firm*—Allen A. Dicke, Jr.; Anthony W. Karambelas

[57] ABSTRACT

An air flow sensor 14 senses the presence of cooling air from a blower 12 to a lamp housing 10. A vane 44 closes an opening 42 when air is flowing to close a switch 50 which permits a lamp 16 to be turned on. The vane 44 does not extend into the air flow path.

2 Claims, 7 Drawing Figures

AIR FLOW SENSOR

BACKGROUND OF THE INVENTION

This invention is directed to an air flow sensor which during flow sensing condition does not protrude into the air flow path.

There are large numbers of industrial installations wherein fluid flow serves as a required portion of the operating system. Such installations include systems wherein gas flow serves to carry along a finely divided solid, and systems wherein the gas itself serves an important function in the process. Quite often the gas is air and it is quite often used as a cooling medium. In all such systems it is desirable, and in some systems necessary to determine the presence of fluid flow so that the system can be shut down in the absence of fluid flow, or back-up systems initiated.

Thus, there is a need for a fluid flow sensor, particularly for the sensing of air flow in cooling systems, where the sensor does not obstruct normal air flow to reduce its flow rate or cause any kind of obstruction.

SUMMARY OF THE INVENTION

In order to aid in the understanding of this invention, it can be stated in essentially summary form that it is directed to a fluid flow sensor for sensing the flow of fluid through a duct. The duct has an opening in the side thereof, and pivoted within the duct upstream of the opening is a sensor vane which swings to close the opening when in the flow sensing position so that differential pressure maintains the vane out of the fluid flow stream.

It is thus a purpose and an advantage of this invention to provide a fluid flow sensor, and particularly a gas flow sensor, which does not protrude into the fluid stream in the duct when flow is sensed so that the sensor presents no fluid flow restrictions during fluid flow.

It is another purpose and advantage of this invention to provide a fluid flow sensor which is of reliable construction and accurately senses fluid flow without any restriction to the fluid flow.

Other purposes and advantages of this invention will become apparent from a study of the following portion of this specification, the claims and the attached drawings.

DESCRIPTION OF THE PREFERRED EMBODIMENT

Figure 1:
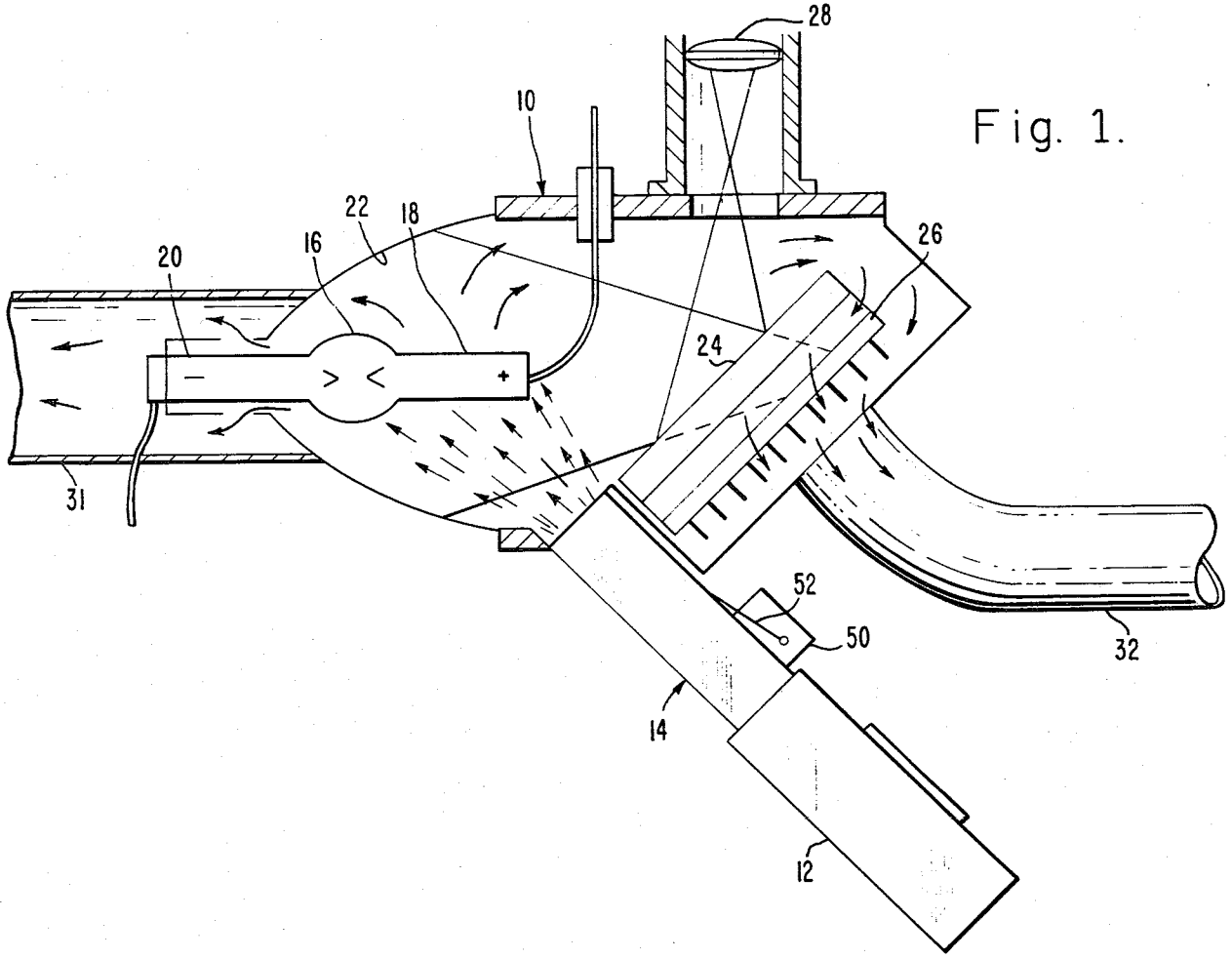
FIG. 1 is a central section through an optical system and its cooled arc lamp housing, showing the air flow sensor in association therewith to sense cooling air flow to the arc lamp and its housing.

FIG. 1 shows an arc lamp housing 10 to which blower 12 delivers air for the cooling thereof. The air flow sensor 14 senses the adequacy of cooling air flow from the blower to housing 10.

Arc lamp housing 10 contains arc lamp 16 with its positive end 18 and its negative end 20. The arc lamp is positioned within reflector 22 which directs the arc lamp radiation to cold mirror 24. Thermal mass 26 absorbes the infrared radiation that passes through the cold mirror. The air passes over and around thermal mass 26 which has cooling fins on the back. The visible radiation of the arc lamp is reflected by cold mirror 24 through lens 28 which is part of the optical system in which the radiation of arc lamp 16 is going to be used.

Air flow sensor 14 includes duct 30, see FIGS. 2–7, which directs the air flow from blower 12 principally onto the positive end 18 of arc lamp 16.

The air duct 30 directs air, delivered by blower 12 in a stream directly onto the positive end of the lamp. The air duct does not protrude into the light path. This means that the air stream must be very directional, so it can not have any obstructions such as paddles in the air stream, as is found in prior art air flow sensitive switches. Furthermore, with a small blower, any such obstruction would severely decrease the air flow. It is the positive end that requires more cooling. Some of the air passes downward around lamp 16, through an opening in reflector 22 out of bottom exhaust duct 31. That air flow cools the negative end 20 of arc lamp 16, and the heated air is discharged away from the equipment. The balance of the air moves toward and cools mirror 24, by passing over the mirror surface and by passing around and over the infrared heat sink thermal mass 26 and over its cooling fins. The heated air is discharged out of exhaust duct 32 away from the equipment.

Flow reduction could be caused by failure of blower 12 or plug-up of the air passages, such as the suction for blower 12 or, should cooling air flow through the duct 30 substantially decrease, the arc lamp 16 would overheat and fail. In order to prevent this, the air flow sensor 14 of this invention is provided, to indicate when air flow from blower 12 is substantially decreased so that the arc lamp 16 can be shut down.

Figure 2:
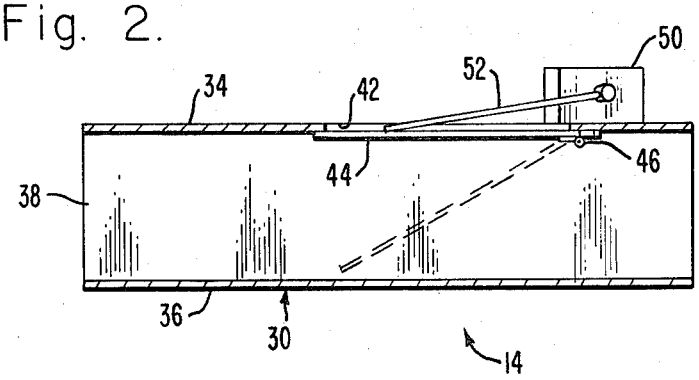
FIG. 2 is a longitudinal section through the air flow sensor of this invention, taken generally along the line 2—2 of FIG. 3.
Figure 3:
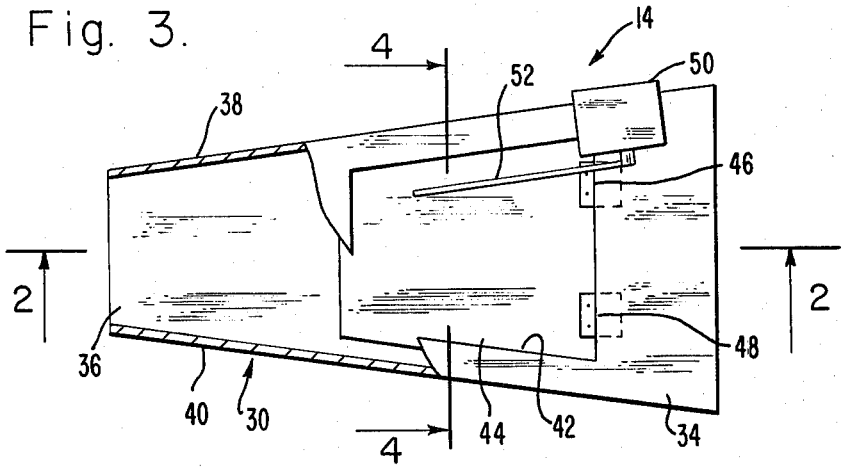
FIG. 3 is a plan view of the air flow sensor of this ivention, as seen from the side of the duct with the port therein, with parts broken away and parts taken in section.
Figure 4:
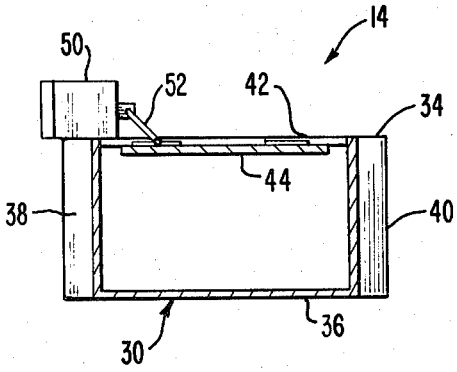
FIG. 4 is a transverse section taken generally along the line 4—4 of FIG. 3.
Figure 5:
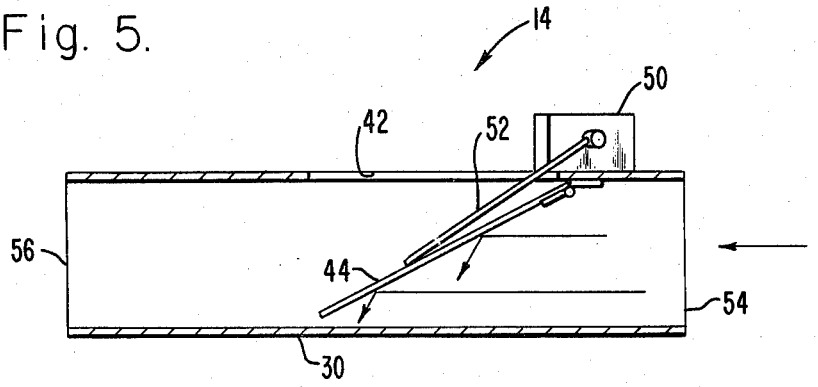
FIG. 5 is a longitudinal section, similar to the view of FIG. 2 showing the sensor at the beginning of air flow.
Figure 6:
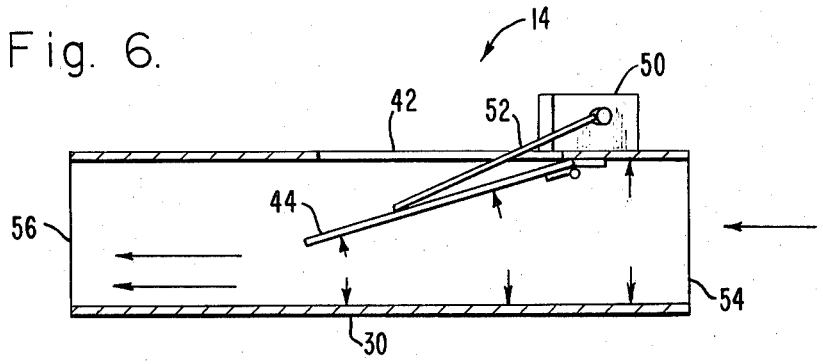
FIG. 6 is a view similar to FIG. 5 showing the air flow sensor during increase in air flow.
Figure 7:
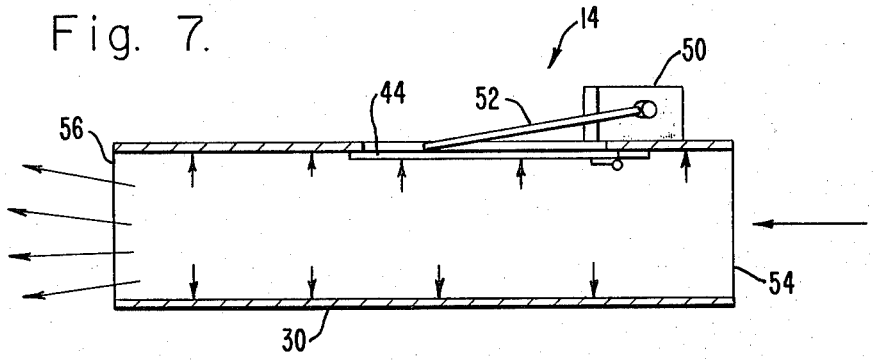
FIG. 7 is a view similar to FIG. 5 showing the physical conditions and pressure conditions within the air flow sensor when it is sensing air flow.

FIGS. 2–4 show the construction of air flow sensor 14 and FIGS. 5–7 show its response to different air flow levels. The structure can operate in any orientation, and is not limited to the orientation shown. Referring to FIGS. 2–4, the duct 30 is shown as having top and bottom walls 34 and 36 as well as side walls 38 and 40. The duct has a substantially rectangular cross-section, and the side walls 38 and 40 are tapered toward each other primarily to fit the air flow openings of the blower 12 and arc lamp housing 10. The size and shape of duct 30 is principally a function of the amount of air flow required and the shape of the devices to which it is attached. As illustrated, it has one wall which is substantially flat to carry the sensing vane. In this case, it is top wall 34 which is substantially flat. However, it could be configured with a curved wall and curved vane.

Top wall 34 has opening 42 therethrough, opening the interior of the duct to the atmosphere. Pivoted within the duct at the upstream end of opening 42 is vane 44 which is sufficiently large to cover opening 42 from the inside when it is pivoted to the position against the interior surface of wall 34, as seen in FIGS. 2–4. Hinges 46 and 48 define the pivot axis of vane 44.

Electric switch 50 is mounted on top wall 34 adjacent opening 42. This switch 50 has an operating arm 52 which engages against vane 44. The structure is such that when the vane is in the upper position where it closes opening 42, the switch 50 is actuated and when the vane 44 is in a lower position, as indicated in FIGS. 5 and 6, the switch is open. This switch provides a signal into the circuitry which controls arc lamp 16 so that the arc lamp is off when the vane 44 is away from its opening 42.

In accordance with this invention a force is necessary to urge vane 44 away from opening 42 in a direction to uncover the opening. When the top wall 34 is oriented in the generally upward direction, as indicated in FIG. 1, then the force of gravity on vane 44 will be sufficient. When the gravity vector does not aid in urging vane 44 away from opening 42, then a spring force can be applied. The spring force may be provided by the structure of switch 50 through its operating arm 52 to urge the vane in the opening direction.

The operation of air flow sensor 14 is indicated in FIGS. 5, 6 and 7. As indicated in FIG. 5, when the blower is first turned, on to raise the pressure in inlet end 54 of duct 30 is compared to its outlet end 56, the pressure drop is taken across vane 44. In the no-flow position, as shown in FIG. 5, vane 44 almost completely obstructs the duct 30 so that substantially all of the pressure produced by blower 12 as taken as pressure drop across vane 44. This pressure drop is sufficient to overcome the opening force, which as described above, is the force of gravity on the vane, and/or the force of operating arm 52 on the vane. The force produced by the pressure drop across vane 44 is greater than its opening force so that the vane 44 moves toward the raised position. In FIG. 6, the vane 44 is shown partly open, and the pressure force is illustrated in FIG. 6 as still producing a net force in the direction to raise vane 44 all the way to its upper position. FIG. 7 shows the vane 44 positioned to close opening 42. In this position it is sensing adequate air flow. The blower 12 supplies sufficient air at inlet end 54, and the outlet end 56 is sufficiently restricted with respect to the flow that the interior pressure in duct 30, acting on vane 44 which has atmospheric pressure on its top side, maintains the vane 44 in the raised position shown in FIG. 7. It is in this position that the pressure within duct 30 is sufficiently higher than the atmospheric pressure to produce the pressure drop across vane 44 to maintain the vane in its raised position. In this position, there is no restriction of sensor duct 30 by vane 44 so that there is no obstruction of the air flow. When the pressure at inlet end 54 drops, as by failure of blower 12, the pressure within duct 30 is insufficient to hold the vane 44 in its raised position. Thereupon, the vane drops, switch 50 opens and lamp 16 is turned off.

This invention has been described in its presently contemplated best mode and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An air flow sensor comprising:

walls defining a duct having an inlet end and an outlet end for passing air therethrough from said inlet end to said outlet end, a blower connected to said inlet end of said duct to blow air therethrough and a lamp housing connected to said outlet end of said duct, said lamp housing having a lamp therein;

an opening in the wall of said duct said wall having said opening therein being substantially planar, said opening being vented away from said duct;

a vane pivoted in said duct on said wall having an opening therein adjacent the upsteam end of said opening, said vane having a first position wherein said vane lies against said wall on the interior of said duct to be unobstructive to air flow through said duct, said vane being configured to cover said opening when in said first position so that pressure in said duct holds said vane in said first position, said vane having a second position wherein said vane uncovers said opening and extends into said duct;

means for urging said vane from said first position toward said second position; and means for detecting when said vane is in said first position so as to signal air flow through said duct, said detecting means comprising an electric switch connected to be actuated by said vane when said vane is in its first position, said switch being connected to said lamp to prevent energization of said lamp when said vane is away from said first position to prevent energization of said lamp in the absence of sufficient air flow to hold said vane in said first position.

2. The fluid flow sensor of claim 1 wherein said duct is substantially rectangular in cross-section perpendicular to air flow therethrough.

* * * * *